US005943741A

United States Patent [19]

Furutsu

[11] Patent Number: 5,943,741

[45] Date of Patent: Aug. 31, 1999

[54] LABEL SUPPORTING MEANS

[75] Inventor: Akira Furutsu, Lion's Station Plaza, 70420-12, 2 chome, Ryogoku, Sumida-ku, Tokyo, Japan

[73] Assignees: Kotec's Co., Ltd.; Akira Furutsu, both of Tokyo, Japan

[21] Appl. No.: 08/933,674

[22] Filed: Sep. 19, 1997

[51] Int. Cl.[6] ..... B65D 63/00

[52] U.S. Cl. ..... 24/16 PB; 24/17 AP; 24/30.5 P

[58] Field of Search ..... 24/16 PB, 17 AP, 24/30.5 P, 3.13

[56] References Cited

U.S. PATENT DOCUMENTS

| | | | |
|---|---|---|---|
| 3,461,510 | 8/1969 | Holmes | 24/16 PB |
| 3,588,963 | 6/1971 | Moberg | 24/16 PB |
| 3,600,027 | 8/1971 | Noland | 24/16 PB |
| 3,712,655 | 1/1973 | Fuehrer | 24/16 PB |
| 3,816,879 | 6/1974 | Merser et al. | 24/16 PB |
| 4,059,300 | 11/1977 | Moberg et al. | 24/16 PB |
| 4,093,288 | 6/1978 | Suzuki | 24/16 PB |
| 4,240,183 | 12/1980 | Sumimoto et al. | 24/16 PB |
| 4,680,836 | 7/1987 | Wisecup | 24/16 PB |
| 4,854,014 | 8/1989 | Ueno | 24/16 PB |
| 5,263,231 | 11/1993 | Sorensen et al. | 24/16 PB |

*Primary Examiner*—Victor N. Sakran
*Attorney, Agent, or Firm*—Greer, Burns & Crain, Ltd.

[57] ABSTRACT

The object of the present invention is to provide a new fastener means in which the inserting part thereof can easily be inserted into the aperture or a through hole provided inside the socket portion, and also to provide a new fastener means with which a desired fastener means can be easily singled out from a bundle thereof without generating any entanglement formed among the fasteners. The label supporting means comprising a linear flexible string portion 3, a holder portion 2 connected to one end of the string portion 3 and a connecting portion 4 connected to another end 32 of the string portion 3. The holder portion 2 is provided with a finger contacted grasping portion 15 between the holder portion 2 and the string portion 3.

19 Claims, 7 Drawing Sheets

LABEL SUPPORTING MEANS

BACKGROUND OF INVENTION

1. Field of Invention

The present invention relates to a label supporting means which can support many kinds of labels such as brand marks, tags, information tags about materials of goods, explanations on how to use or treat goods, price tags or the like, and is capable of being attached to many kinds of goods to be sold in shops.

2. Description of the Related Art

One embodiment of a conventional fastener is shown in U.S. Pat. No. 4,240,183, and as shown in attached FIGS. 1 and 2, it is disclosed that the fastener 10 comprises a long filament portion. Additionally, 3 as an intermediate portion, a socket portion 2 and an inserting part 4 are provided on each of the ends of the filament portion 3. It is also disclosed that each of the abovementioned portions are integrally formed into one piece so as to form a fastener 10.

This kind of fastener 10 can be used by inserting the inserting portion 4 into the aperture 11 formed in the socket portion 2 in one direction, which anchors it to the socket 2 very tightly.

Note that when the inserting portion 4 is inserted into the aperture 11 of the socket 2, a tongue portion 5 (which is provided at a top end portion of the inserting portion 4 and has flexibility and suitable resilience) is engaged in a stopper portion 12 provided inside the aperture 11 of the socket portion 2.

A tag or label 20 indicating the quality, price or the like is carried by the above-mentioned filament portion 3, which can be attached to any kind of goods.

When a tag, a label or the like 20 is attached to an article by using such fastener, a worker or an operator may attempt to pick up at least one fasteners 10 from a bundle of the fasteners in which a plurality of the fastener as described in FIG. 1 are randomly grouped, as shown in FIG. 4, by grasping the inserting part thereof with his or her finger tip portion. However, due to the heavily entangled condition among the filaments 3 and the socket portions 2 thereof, it is very difficult for the operator to single a specific fastener from the bundle thereof.

Note that the above-mentioned entanglement is because the filament portion is connected to the socket portion with approximately a right angle with respect to a center axis of the aperture of the socket portion.

Further, when the operator intends to insert the inserting part thereof into an aperture formed in the socket portion, after the inserting part carrying the label or tag has passed through an aperture or a hole or suitable connecting portion provided on a good, the operator will usually grasp the socket portion thereof with the tips of his fingers, and support it between his finger tips as shown in FIG. 3.

However, since the socket portion usually has a very tiny body, per se, and thus the socket portion is usually kept between the finger tip portions of the operator so that at least a part of each of the end portions of the aperture of the socket portion are necessarily sealed by the finger surface of the operator, which reduces the effective size of the aperature, and makes insertion difficult. Accordingly, the efficiency of the label attaching operation is reduced.

Therefore, an object of the present invention is to improve the abovementioned drawbacks as raised in the conventional fastener to thereby provide a new fastener means in which the inserting part thereof can easily be inserted into the aperture or a through hole provided inside the socket portion, and also to provide a new fastener means with which a desired fastener means can be easily singled out from a bundle thereof without generating any entanglement formed among the fasteners.

SUMMARY OF THE INVENTION

To attain the object of the present invention as mentioned above, a label supporting means has basically the following technical conception in that a label supporting means comprising a linear flexible string portion, a holder portion connected to one end of the string portion and a connecting portion connected to another end of the string portion. Wherein the holder portion of the label supporting means has a through hole conduit formed inside the holder portion so that a center axis of the through hole conduit makes a right angle with a center axis of the string portion which is connected to the holder portion and has a stopper portion formed inside the through hole conduit. The connecting portion of a diameter that is relatively thicker than that of the string portion, and is relatively inflexible, is connected to the string portion so that a center axis of the connecting portion is parallel with the center axis of the string portion. Further, the connecting portion has a configuration so that at least a tip portion of the string portion is enabled to be inserted into the through hole conduit, and also has a flexible tongue portion which can abut against the stopper portion formed inside the through hole conduit. Additionally, the holder portion is provided with a finger contacted grasping portion between the holder portion and the string portion.

DETAILED DESCRIPTION OF THE INVENTION

The embodiments of the present invention will be described with reference to the following drawings, hereunder.

Figure 5:
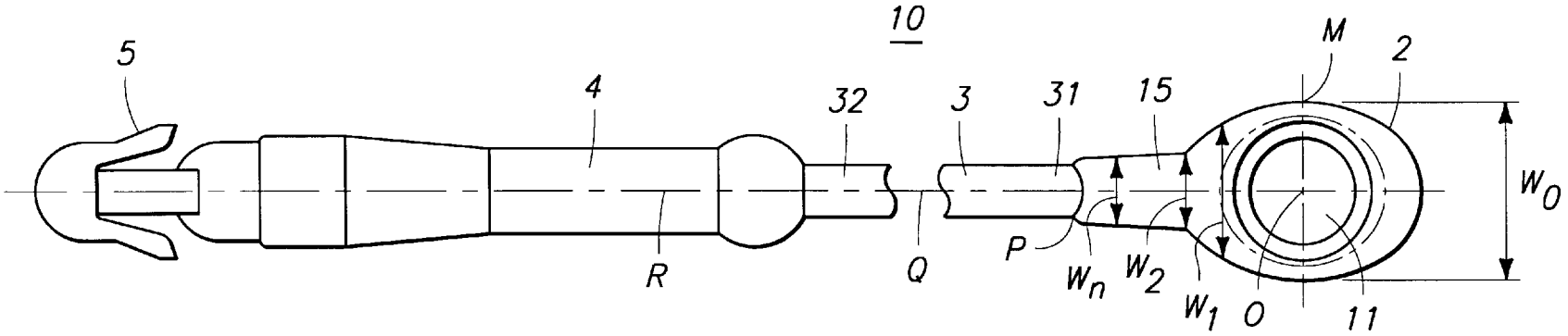
FIG. 5 shows a side view of one embodiment of a label supporting means of the present invention.
Figure 6:
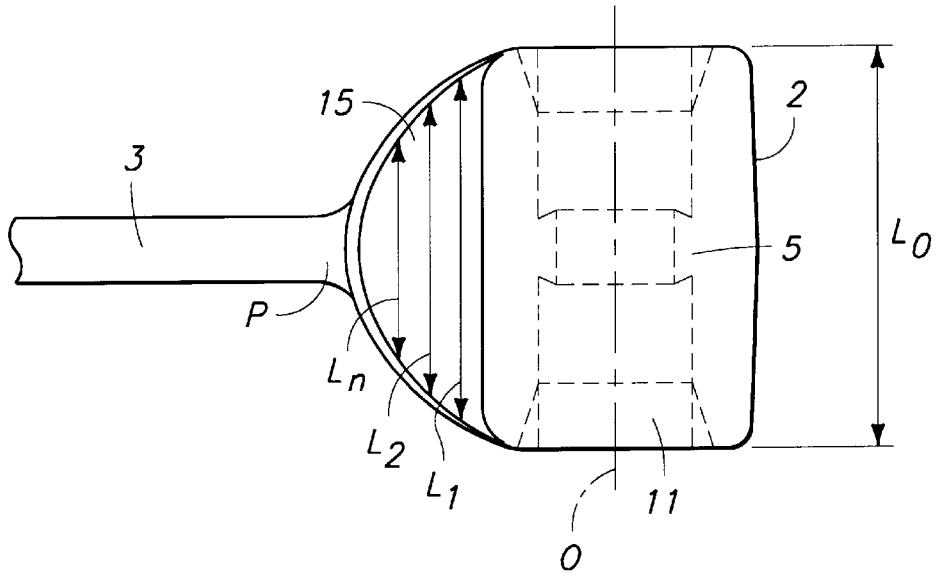
FIG. 6 shows a plan view of a holder portion in the label supporting means of the present invention.

FIGS. 5 and 6 show a first preferred embodiment of the label supporting means 10 of the present invention, and in these figures is shown a label supporting means 10 comprising a linear flexible string portion 3, a holder portion 2 connected to one end 31 of the string portion 3 and a connecting portion 4 connected to another end 32 of the string portion 3. The holder portion 2 of the label supporting means 10 has a through hole conduit 11 formed inside the holder portion 2 so that a center axis O of the through hole conduit 11 makes approximately a right angle with a center axis Q of the string portion 3, which is connected to the holder portion 2 and a stopper portion 12 formed inside the through hole conduit 11. The connecting portion 4 has a diameter thereof that is relatively thicker than that of the string portion 3 and is relatively inflexible. The connecting portion 4 is connected to the string portion 3 so that a center axis R of the connecting portion 4 is parallel with the center axis Q of the string portion 3. The connecting portion 4 has a configuration so that at least a tip portion of the string portion is enabled to be inserted into the through hole conduit 11 and also a flexible tongue portion 5 which can abut against the stopper portion 12 formed inside the through hole conduit 11. The holder portion 2 is provided with a finger contacted grasping portion 15 between the holder portion 2 and the string portion 3.

Figure 7:
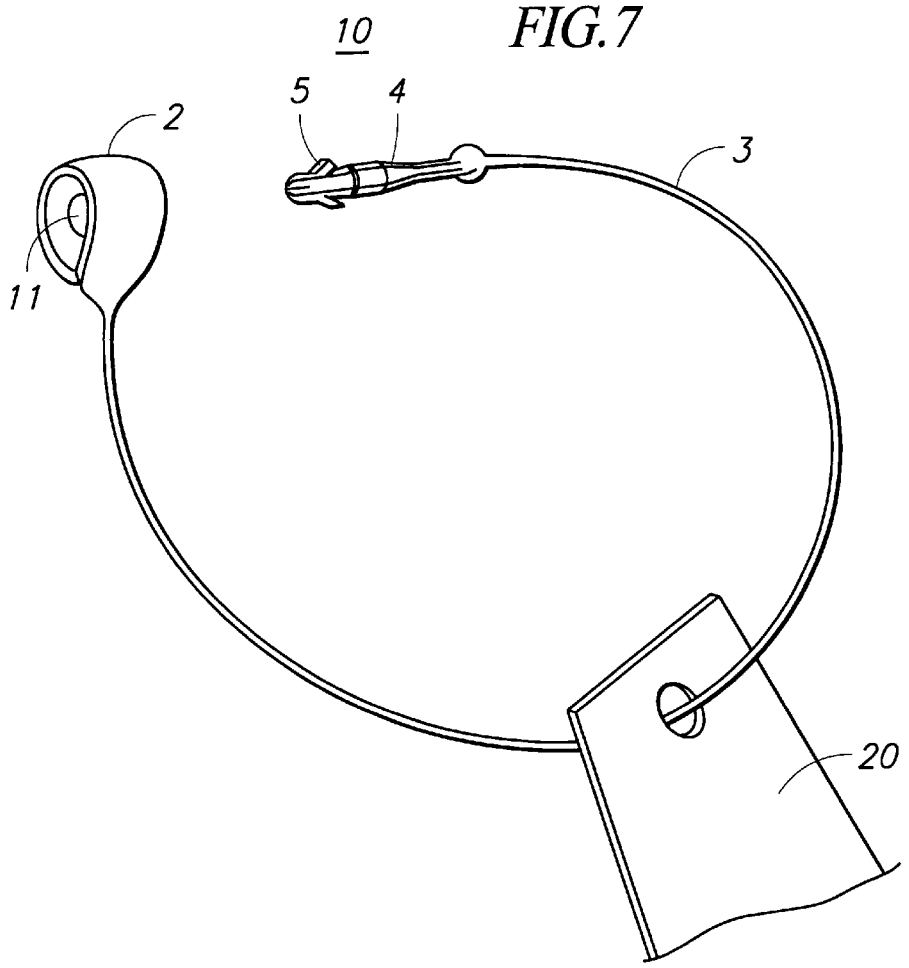
FIG. 7 shows a schematic view of the label supporting means of the present invention showing how to use this label supporting means.
Figure 8:
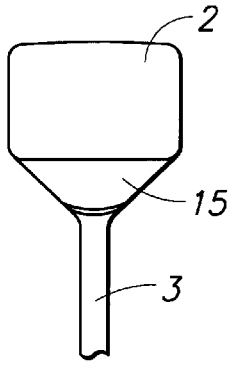
FIGS. 8 and 9 show side views illustrating one embodiment of the socket portion as well as the finger contacted grasping portion of the label supporting means in the present invention.
Figure 9:
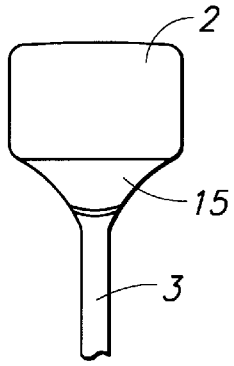
Figure 10:
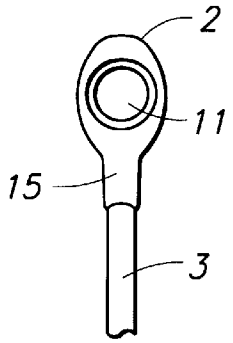
FIGS. 10 and 11 show front views illustrating one embodiment of the socket portion as well as the finger contacted grasping portion of the label supporting means in the present invention.
Figure 11:
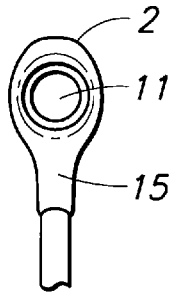

One embodiment of a construction of the label supporting means 10 of the present invention and one embodiment of a method in using this label supporting means are shown in FIG. 7.

Figure 1:
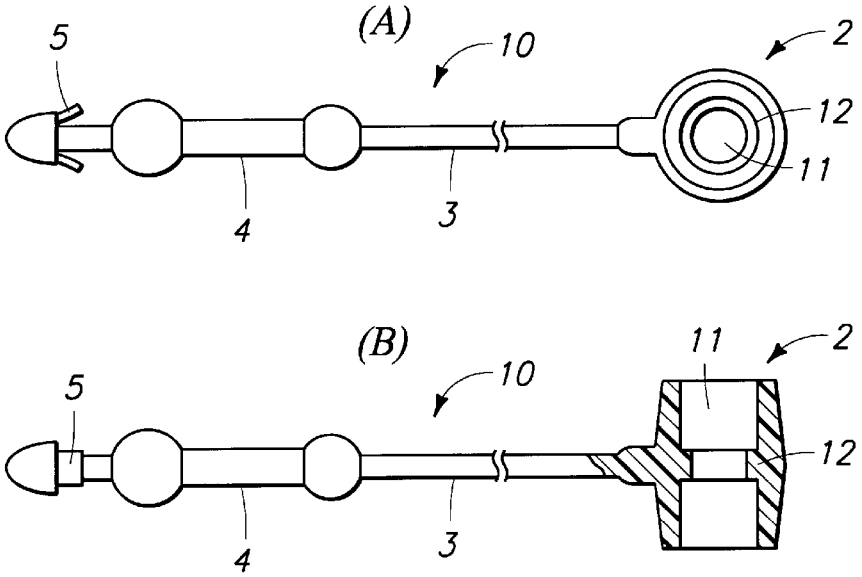
FIG.1 PRIOR ART
FIGS. 1(A) and 1(B) show a side view and a plan view of a conventional fastener, respectively.
Figure 2:
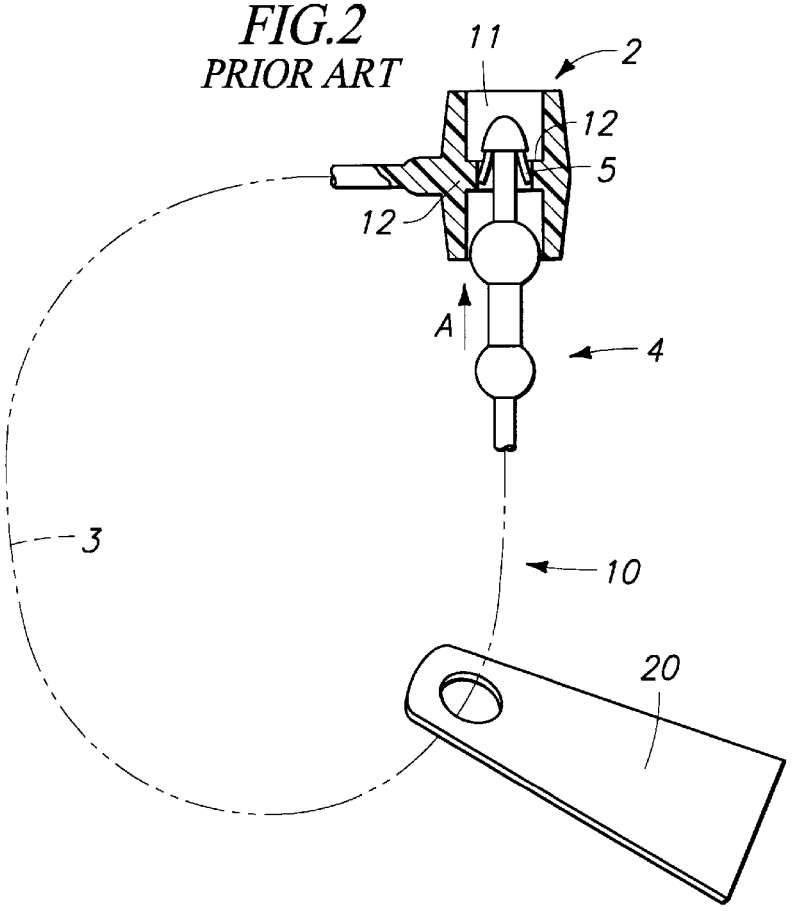
FIG.2 PRIOR ART
FIG. 2 shows a condition in that an inserting portion is inserted into an aperture of a socket portion with a filament portion having a label.
Figure 3:
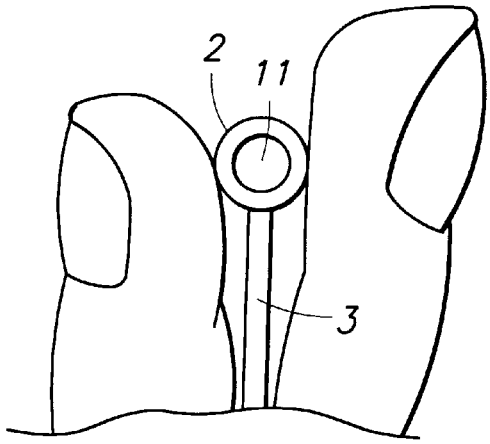
FIG.3 PRIOR ART
FIG. 3 illustrates a condition in which a socket portion is held between finger tip portions when the conventional fastener is used.
Figure 4:
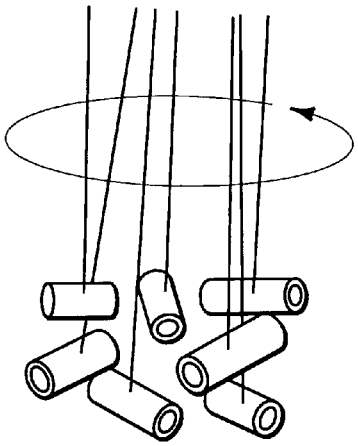
FIG.4 PRIOR ART
FIG. 4 illustrates a condition in that a plurality of fasteners are bundled.

In attaching a certain label or tag to a desired good with this label supporting means 10, as shown in FIG. 2, any kind of label 20 such as brand marks, tags, information tags about materials of goods, explanation on how to use or treat goods, price tags or the like, is engaged in the string portion 3 of this label supporting means 10, and then after the connecting portion 4 is passed through any one of the suitable apertures, openings, slits, buttons, or belt holders or the like of the desired kind of goods, the connecting portion 4 is inserted into the through hole conduit 11 of the holder portion 2 so as to complete the label attaching operation.

Figure 12:
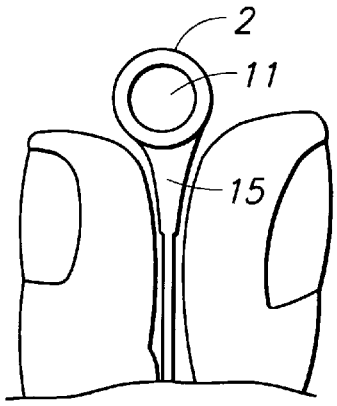
FIG. 12 illustrates a condition in which a socket portion is held between finger tip portions when the label supporting means of the present invention is used.

In the present invention, as shown in FIG. 12, when an operator intends to pick up at least one of the label supporting means 10 and hold the holder portion 2 thereof within his finger tip portions in order to insert the connecting portion 4 of the label supporting means 10 into the through hole conduit 11, the holder portion 2 can be stably held over the tip portions of the fingers of the operator with both apertures formed at both ends of the through hole conduit 11 being in a fully opened condition due to the existence of the finger contacted grasping portion 15 provided between the holder portion 2 and the string portion 3.

Thus, it is very easy for the operator to insert the connecting portion 4 of the label supporting means 10 into the through hole conduit 11, and accordingly the efficiency of the operation for inserting the connecting portion 4 into the through hole conduit 11 can be remarkably improved.

Therefore, in the present invention, it is preferable that the finger contacted grasping portion 15 has been set with dimensions so that when an operator picks up the label supporting means 10 by his finger tips, the through hole conduit 11 of the holder portion 2 can be held above the finger tips of the operator.

A preferred embodiment of the finger contacted grasping portion 15 of the present invention preferably has the configuration in that the finger contacted grasping portion 15 has a first configuration in a side view thereof when viewed with respect to a plane surface formed in parallel with the center axis O of the through hole conduit 11 of the holder portion 2, in that (as shown in FIG. 6) a length L thereof measured in parallel with the center axis O of the through hole conduit is set at a maximum value L0 at a location close to the through hole conduit 11 and the length L (L1, L2 L3 . . . Ln) is gradually reduced toward the contacting point P formed between the finger contacted grasping portion 15 and the string portion 3. The same preferred embodiment also has a second configuration in a cross-sectional view thereof when viewed with respect to a plane surface formed transverse to the center axis O of the through hole conduit 11 of the holder portion 2, in that (as shown in FIG. 5) a width W thereof measured in diagonal to the center axis O of the through hole conduit 11 is set at a maximum value W0 at a location close to the through hole conduit 11 and the width W (W1, W2, W3, . . . Wn) is gradually reduced toward the contacting point P formed between the finger contacted grasping portion 15 and the string portion 3.

One embodiment of the first configuration or the second configuration of the finger contacted grasping portion 15 of the present invention is shown in FIGS. 8, 9, 10 and 11, respectively and in that a contour of at least one of the first and second configurations of the finger contacted grasping portion 15 may consist of curved lines.

In another embodiment thereof, a contour of at least one of the first and second configurations of the finger contacted grasping portion 15 may consist of linear lines.

Further, in the present invention, a contour of at least one of the first and second configurations of the finger contacted grasping portion 15 may be consisted of linear lines and curved lines.

Figure 13:
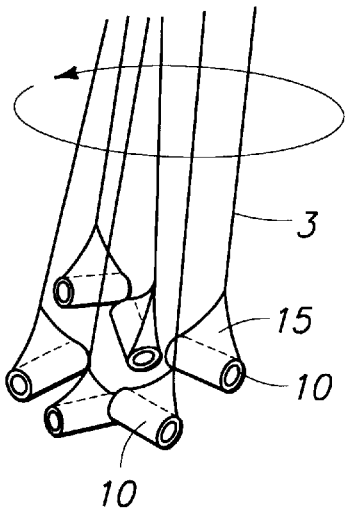
FIG. 13 illustrates a condition in that a plurality of label supporting means are bundled.

In the present invention, since the finger contacted grasping portion 15 having the first and second configurations is provided at a portion formed between the holder portion 2 and the string portion 3, as shown in FIG. 13, even when a plurality of label supporting means 10 are transferred in a bundled condition or grasped by the operator in the form a bundle, the entanglement caused by the string portion 3 and the holder portion 2 is effectively prevented, and thus one holder portion 10 can be easily singled out from this bundle of holder portions 10, without generating any trouble among them caused by entanglement.

Therefore, the label attaching operation to a suitable good can be done smoothly, and accordingly efficiency of this operation can be remarkably improved.

In another embodiment of the present invention, an area of at least one end portion of the through hole conduit 11 formed in the holder portion 2 is larger than the area as formed at a portion located inwardly from the both ends of the through hole conduit 11.

A second preferred embodiment of the present invention is shown in FIGS., 14 and 15, in that the aperture 16 of the through hole conduit 11 formed at the outer ends of the through hole conduit 11 has an area larger than that of the aperture 17 thereof formed at an inward portion of the conduit 11.

Figure 14:
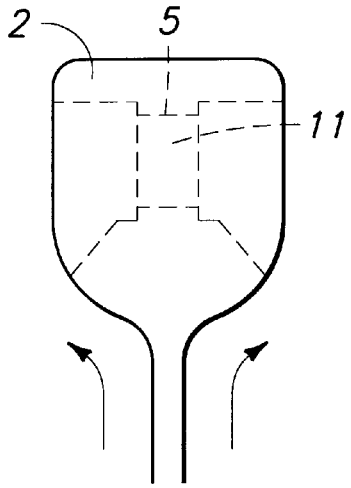
FIGS. 14 and 15 show a side view and a plan view of another embodiment of the holder portion of the present invention, respectively.
Figure 15:
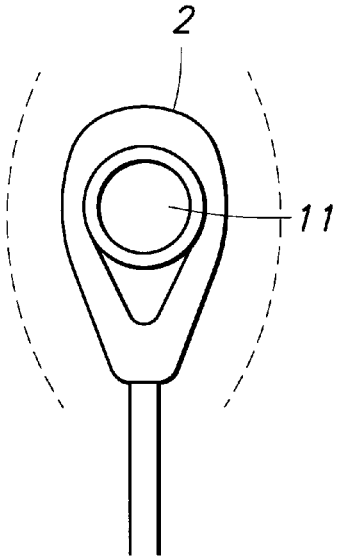

Taking this configuration as shown in FIGS. 14 and 15, the operation for inserting the connecting portion 4 into the through hole conduit 11 can be simplified so that the efficiency of this operation can also be improved.

Further in the present invention, the string portion 3, the holder portion 2 connected to one end 31 of the string portion 3, the connecting portion 4 connected to another end 32 of the string portion 3 and the finger contacted grasping portion 15 are desirably formed integrally into one piece.

In the present invention, the label supporting means 10 is preferably made of synthetic resin material for example, Nylon or Polypropylene.

The flexible linear string portion 3 of the present invention may be formed by drawing undrawn synthetic resin material in a heated condition so as to have a fine diameter and suitable flexibility. The connecting portion 4 can be made to have a relatively larger diameter compared with that of the string portion 3 and to have a solid or rigid configuration sufficient to be inserted into the through hole conduit 11.

Moreover, in the present invention, the construction of the stopper means 12 provided inside the through hole conduit 11 and the tongue means 5 provided on the connecting portion 4 and to be engaged with the stopper means 12 can be formed with any kind of configuration, as long as it can serve the function as required in the present invention.

What is claimed is:

1. A label supporting device comprising:

a flexible string portion including a first end and a second end;

a holder portion connected to said first end of flexible string portion;

a connecting portion connected to said second end of said flexible string portion, said connecting portion having a diameter larger than that of said flexible string portion so that said connecting portion is relatively inflexible;

a flexible tongue portion located on said connecting portion;

a through hole conduit formed within said holder portion, said through hole conduit extending in a direction transverse to a central axis of said flexible string portion;

a stopper portion formed within said through hole conduit, said stopper portion being configured and arranged so that when at least a tip portion of said connecting portion is inserted into said through hole conduit, said flexible tongue portion abuts against said stopper portion to prevent withdrawal of said connecting portion from said holder portion; and a finger grasping portion positioned between said holder portion and said flexible string portion, said finger grasping portion being of a configuration sufficient to enable a user to grasp said finger grasping portion without obstructing access to said through hole conduit.

2. The label supporting device according to claim 1, wherein said finger grasping portion has been set with dimensions so that when said user picks up said label supporting means by his finger tips, said through hole conduit of said holder portion can be held above said finger tips of said user.

3. The label supporting device according to claim 2, wherein said finer grasping portion has a first configuration in a side view thereof when viewed with respect to a plane surface formed in parallel with said center axis of said through hole conduit of said holder portion, in that a length thereof measured in parallel with said center axis of said through hole conduit is a maximum value at a location close to said through hole conduit and said length is gradually reduced toward a contacting point formed between said finger grasping portion and said string portion, while having a second configuration in a cross-sectional view thereof when viewed with respect to a plane surface formed in a transverse direction to said center axis of said through hole conduit of said holder portion, in that a width thereof measured in said transverse direction to said center axis of said through hole conduit is set to a maximum valve at a location close to said through hole conduit and said width is gradually reduced toward said contacting point formed between said finger grasping portion and said string portion.

4. The label supporting device according to claim 3, wherein a contour of at least one of said first and second configurations of said finger grasping portion consists of linear lines.

5. The label supporting device according to claim 3, wherein a contour of at least one of said first and second configurations of said finger grasping portion consists of curved lines.

6. The label supporting device according to claim 3, wherein a contour of at least one of said first and second configurations of said finger grasping portion consists of linear lines and curved lines.

7. The label supporting device according to claim 1, wherein said string portion, said holder portion connected to said first end of said string portion, said connecting portion connected to said second end of said string portion and said finger grasping portion are formed integrally as one piece.

8. A label supporting according to claim 7, wherein said label supporting device is made of synthetic resin material.

9. The label supporting device according to claim 1 wherein said finger grasping portion is also configured to minimize entanglement with other like label supporting devices when a plurality of said label supporting devices are grouped together with said holder portions adjacent each other.

10. The label supporting device according to claim 1 wherein said finger grasping portion comprises a flange extending generally towards said flexible string portion and generally adjacent said through hole conduit.

11. The label supporting device according to claim 1 wherein said finger grasping portion is generally in the form of semicircle when viewed from a direction perpendicular to said extension direction of said through hole conduit.

12. The label supporting device according to claim 1 wherein said finger grasping portion comprises a flange extending from said holder portion in a direction generally parallel to said extension direction of said through hole conduit.

13. A label supporting device comprising:

a flexible string portion including a first end and a second end;

a holder portion connected to said first end of flexible string portion;

a connecting portion connected to said second end of said flexible string portion;

a through hole conduit formed within said holder portion;

a stopper portion formed within said through hole conduit, said stopper portion being configured and arranged so that when at least a tip portion of said connecting portion is inserted into said through hole conduit, said stopper portion prevents withdrawal of said connecting portion from said holder portion; and a finger grasping portion positioned between said holder portion and said flexible string portion, said finger grasping portion being of a configuration sufficient to enable a user to grasp said finger grasping portion without obstructing access to said through hole conduit.

14. The label supporting device according to claim 13 wherein said finger grasping portion is also configured to minimize entanglement with other like label supporting devices when a plurality of said label supporting devices are grouped together with said holder portions adjacent each other.

15. The label supporting device according to claim 13 wherein said finger grasping portion comprises a flange extending generally towards said flexible string portion and generally adjacent said through hole conduit.

16. The label supporting device according to claim 13 wherein said finger grasping portion is generally in the form of semicircle when viewed from a direction perpendicular to said extension direction of said through hole conduit.

17. The label supporting device according to claim 13 wherein said finger grasping portion comprises a flange extending from said holder portion in a direction generally parallel to said extension direction of said through hole conduit.

18. The label supporting device according to any one of claims 1 or 13, wherein an area of at least one end portion of said through hole conduit formed in said holder portion is larger than an area formed at a portion located inwardly from both ends of said through hole conduit.

19. A label supporting device comprising:

a flexible string portion including a first end and a second end;

a holder portion connected to said first end of flexible string portion;

a connecting portion connected to said second end of said flexible string portion, said connecting portion having a diameter larger than that of said flexible string portion so that said connecting portion is relatively inflexible;

a flexible tongue portion located on said connecting portion;

a through hole conduit formed within said holder portion, said through hole conduit extending in a direction transverse to a central axis of said flexible string portion;

a stopper portion formed within said through hole conduit, said stopper portion being configured and arranged so that when at least a tip portion of said connecting portion is inserted into said through hole conduit, said flexible tongue portion abuts against said stopper portion to prevent withdrawal of said connecting portion from said holder portion;

a finger grasping portion positioned between said holder portion and said string portion;

wherein said finger grasping portion has been set with dimensions so that when said user picks up said label supporting means by his finger tips, said through hole conduit of said holder portion can be held above said finger tips of said user; and further wherein said finger grasping portion has a first configuration in a side view thereof when viewed with respect to a plane surface formed in parallel with said center axis of said through hole conduit of said holder portion, in that a length thereof measured in parallel with said center axis of said through hole conduit is a maximum value at a location close to said through hole conduit and said length is gradually reduced toward a contacting point formed between said finger grasping portion and said string portion, while having a second configuration in a cross-sectional view thereof when viewed with respect to a plane surface formed in a transverse direction to said center axis of said through hole conduit of said holder portion, in that a width thereof measured in said transverse direction to said center axis of said through hole conduit is set to a maximum valve at a location close to said through hole conduit and said width is gradually reduced toward said contacting point formed between said finger grasping portion and said string portion.

* * * * *

UNITED STATES PATENT AND TRADEMARK OFFICE

CERTIFICATE OF CORRECTION

PATENT NO. : 5,943,741
DATED : Furutsu
INVENTOR(S) : August 31, 1999

It is certified that error appears in the above-identified patent and that said Letters Patent is hereby corrected as shown below:

Column 1, line 16, delete "portion.

Additionally, 3" and insert --portion 3-- therefor

Column 1, line 16, delete "intermediate portion." and insert --intermediate portion. Accordingly,-- therefor

Column 1, line 42, after "single" insert

--out--

Column 1, line 61, delete "aperature" and insert --aperture-- therefor

UNITED STATES PATENT AND TRADEMARK OFFICE

CERTIFICATE OF CORRECTION

PATENT NO. : 5,943,741

DATED : Furutsu

INVENTOR(S) : August 31, 1999

It is certified that error appears in the above-identified patent and that said Letters Patent is hereby corrected as shown below:

Column 2, line 16, after "makes" insert

--approximately--

Column 3, line 16, after "2 and" insert

--has--

Column 3, line 25, after "conduit 11" insert

--,-- (comma)

Column 3, line 25, after "also" insert --has--

Column 3, line 38, delete "explanation" and insert --explanations-- therefor

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*